United States Patent [19]

Verstraeten

[11] Patent Number: 4,659,257

[45] Date of Patent: Apr. 21, 1987

[54] METHOD FOR MAKING A HOLE IN THE GROUND, AND HOLLOW BODY OPEN AT THE LOWER AND UPPER SIDES AND ADAPTED FOR USE IN THIS METHOD

[75] Inventor: Alexander J. Verstraeten, Knokkeheist, Belgium

[73] Assignee: Funderingstechnieken Verstraeten B.V., Netherlands

[21] Appl. No.: 788,763

[22] Filed: Oct. 18, 1985

[30] Foreign Application Priority Data

Oct. 29, 1984 [NL] Netherlands ..... 8403277

[51] Int. Cl.[4] ..... E02D 7/24; E02D 11/00

[52] U.S. Cl. ..... 405/248; 405/232; 175/20; 175/60

[58] Field of Search ..... 405/248, 225, 232, 233, 405/240, 241, 236; 175/20, 60, 247

[56] References Cited

U.S. PATENT DOCUMENTS

| | | | |
|---|---|---|---|
| 1,065,229 | 6/1913 | Estes | 405/248 X |
| 1,173,355 | 2/1916 | Jones | 405/248 |
| 1,729,422 | 9/1929 | Gleasner | 405/248 X |
| 3,419,092 | 12/1968 | Elenburg | 175/60 X |
| 3,599,732 | 8/1971 | Kroon | 175/20 |
| 3,621,924 | 11/1971 | Lebourg | 175/20 X |
| 3,630,036 | 12/1971 | Van Weele | 405/233 |
| 3,763,654 | 10/1973 | Matsushita | 405/232 |
| 3,815,374 | 7/1972 | Hogan | 405/248 |
| 3,852,971 | 12/1974 | Phares | 405/236 |

FOREIGN PATENT DOCUMENTS

| | | | |
|---|---|---|---|
| 347680 | 1/1922 | Fed. Rep. of Germany | 405/248 |
| 0204223 | 11/1983 | Japan | 405/248 |

*Primary Examiner*—Cornelius J. Husar
*Assistant Examiner*—Todd G. Williams
*Attorney, Agent, or Firm*—Kane, Dalsimer, Kane, Sullivan and Kurucz

[57] ABSTRACT

A method and a hollow body for forming a hole in the ground are disclosed. After the hollow body has been brought to the desired depth in the ground high pressure fluid is jetted through spray nozzles into the hollow body near the lower end thereof. The fluid jets effect a cutting of the ground core in the hollow body whereafter the pressurized fluid displaces the overhead ground core upwardly. The spray nozzles are spaced circumferentially and lie in the same transverse plane so that a very flat horizontal cut in the ground is accomplished by the fluid jets.

27 Claims, 9 Drawing Figures

METHOD FOR MAKING A HOLE IN THE GROUND, AND HOLLOW BODY OPEN AT THE LOWER AND UPPER SIDES AND ADAPTED FOR USE IN THIS METHOD

BACKGROUND OF THE INVENTION

The invention relates to a method for forming a hole in the ground, particularly for forming a foundation element or the like in the ground, wherein a hollow body, such as a tube open at the lower and upper sides is urged into the ground, and the ground which has penetrated into the hollow body is removed from the hollow body by means of pressurized fluid which, after the hollow body has been brought to depth in the ground, is supplied into the hollow body near the lower side thereof and which presses the ground in the hollow body upwardly; as well as to a hollow body open at the lower and upper sides such as a tube and adapted for use in this method.

In a known method as described hereinabove, after the hollow body has reached its lowermost position in the ground, a cable end loop, which lies in the hollow body near the lower end thereof is closed when the cable, which is being led upwardly along the outer side of the hollow body, is pulled at its upper end, causing the end loop to cut through the ground so as to form a lower surface for the ground in the hollow body.

However, the use of such an end loop has the disadvantage that it can get out of order during work although it is received in a V-shaped groove formed in the interior of the body and furthermore the end loop can be moved upwardly one sided at its connection to the upwardly extending cable as a result of the upwardly directed force exerted thereon, whereby the cut through the ground will be inclined. This latter is very undesirable, because hereby the lower face of the foundation element or the like to be formed in the ground will also be inclined and will exert great horizontal forces on the ground under influence of a vertical load.

SUMMARY OF THE INVENTION

In the first place it is an object of the present invention to provide a method of the kind mentioned in the preamble, with which the disadvantages are removed in an efficient way.

For this purpose the method according to the invention is characterized in that pressurized fluid, for instance bentonite or the like is sprayed into the hollow body at a small distance above the lower edge of the hollow body out of spray nozzles, which open into the hollow body and lie at the same height and which are spaced about the circumference of the hollow body, whereby the sprayed pressurized fluid effects a cutting of the ground in the hollow body at the height of the spray nozzles, whereupon this pressurized fluid displaces the overhead ground column upwardly along some distance in the hollow body.

As a consequence of the use of the fluid jets which are injected into the ground with a great force at a same level it is possible to accomplish a very flat horizontal cut through the ground in the hollow body. This causes the foundation element or the like which is formed in the ground to also obtain a flat lower surface, whereby the foundation element or the like can only exert vertical forces on the underlying ground.

In order to accomplish that the ground in the hollow body while bringing this hollow body to the right depth is being disturbed as little as possible, which further promotes the formation of a flat cut in the ground by means of the water jets, it is possible according to the invention that at least when the hollow body is being urged into the ground, the inner wall of this hollow body is lubricated with a lubricant, such as bentonite, which is supplied under pressure in the upward direction along the inner tube of the hollow body near the lower side thereof but at a higher level than the spray nozzles.

According to an important embodiment of the method according to the invention it is proposed that after the pressurized fluid supplied through the spray nozzles into the hollow body has moved the ground in the hollow body upwardly along some distance, at least one inlet opening having a greater passage than that of the spray nozzles is released by the ground and a pressurized fluid, for instance water, is supplied into the hollow body, which fluid continues the upward displacement of the ground in the hollow body.

In connection with the greater passage of the inlet opening(s) the further upward displacement of the ground in the hollow body can be executed very quickly.

In the known method a sealing is formed underneath the lower surface of the ground in the hollow body so as to prevent the fluid supplied into the hollow body from penetrating into the ground, when this ground is well permeable. For this purpose sheet-like closing elements, such as pieces of plastics foil having an area of several square centimeters are added to the pressurized fluid.

It has been found that such a sealing cannot avoid the ground to be out washed during the upward displacement of the ground column in the hollow body by the pressurized fluid, whereby an accumulation of loose ground particles can be formed on the face of intersection which is formed by the water jets, wherein the accumulation of loose ground particles can cause a great subsidence of the foundation element or the like to be formed in the hole in the ground and furthermore can lead to an uneven lower surface of this foundation element or the like. If the accumulation of loose ground particles causes a formation of a cavity in the lower surface of the foundation element or the like the upright walls can break, which can have an adverse effect on the load-carrying capicity of the foundation element or the like.

In order to prevent this from happening it is proposed according to the invention that after a sufficient space is created underneath the lower surface of the ground in the hollow body, a piston-like plug is formed or supplied underneath this lower surface, the piston-like plug having a height of at least $\frac{1}{4}$ times the diameter and preferably at least about $\frac{1}{2}$ times the diameter of the hollow body and extending over the whole interior cross-section of the hollow body.

Such a coherent piston-like plug not only prevents loose ground particles from falling down during the upward displacement of the ground in the hollow body by the pressurized fluid, but also efficiently seals the lubricating fluid film on the inner wall of the hollow body at its lower side, so that it is avoided that pressurized fluid could evade upwardly as a consequence of the upward blowing of this lubricant around the ground column.

Preferably the piston-like plug underneath the lower surface of the ground in the hollow body is supplied or formed after the ground in the hollow body has been displaced upwardly along 50 cm–1 m.

A particularly advantageous embodiment of the method described hereinabove is characterized by the step, wherein swelling globules are temporarily added to the pressurized fluid, which is supplied through the inlet opening(s) into the hollow body, the swelling globules rising upwardly after they have been swelled and forming the piston-like plug underneath the lower surface of the ground in the hollow body.

Herein it is of importance to interrupt the supply of the pressurized fluid into the hollow body through the inlet opening(s) after the addition of the swelling globules, until the swelling globules are expanded and have risen to the lower surface of the ground in the hollow body.

The piston-like plug can be obtained in several other ways instead of by using swelling globules.

The invention further comprises a hollow body open at the lower and upper sides such as a tube and adapted for use in the method described hereinabove.

This hollow body is characterized in that a number of spray nozzles open into the hollow body at a small distance above the lower edge of the hollow body, the center lines of the spray nozzles lying in one transverse plane of the hollow body spaced about the circumference thereof, whilst the spray nozzles can be connected to a pressurized fluid supply through at least one line.

It is possible that an circumferentially extending channel is formed in the hollow body by transversely joining elastic elements at a level higher than the spray nozzles, the elastic elements being mounted on an annular thickening in the hollow body and extending upwardly an outwardly from this thickening and resting in the rest position with their upper edge against the inner wall of the hollow body, wherein at least one line opens into the circumferentially extending channel and can be connected to a supply of a pressurized lubricant.

The invention will hereafter be elucidated with reference to the drawings, which show several embodiments of the method according to the invention by way of example, as well as the hollow body used herein.

DESCRIPTION OF THE PREFERRED EMBODIMENTS

Figure 1:
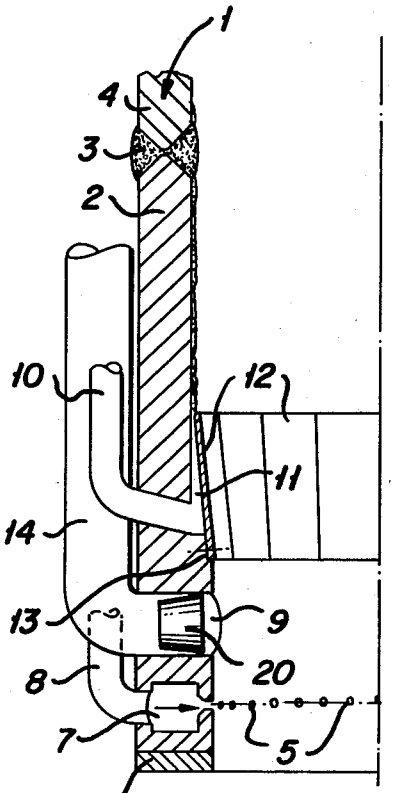
FIG. 1 is a partial longitudinal section of a first embodiment of the lower portion of a hollow body according to the invention.

FIG. 1 shows a half section of the lower portion of a hollow body 1, open at the lower and upper sides, in particular a tube.

This hollow body 1 is adapted to be used for forming a hole in the ground, which particularly serves for forming a foundation element or the like in the ground.

In the embodiments as shown, the hollow body 1 comprises a lower ring 2, which by means of a welded joint 3 is connected to the portion 4 of the hollow body situated thereabove.

In this lower ring 2 a number of spray nozzles 5 are provided, which lie at a small distance above the lower edge of the lower ring 2 and which are spaced about the circumference of the lower ring 2. The spray nozzles 5 open into the interior of the lower ring 2 of the hollow body 1.

The center lines of these spray nozzles 5 extend in one transverse plane of the lower ring 2 of the hollow body 1.

Figure 3:
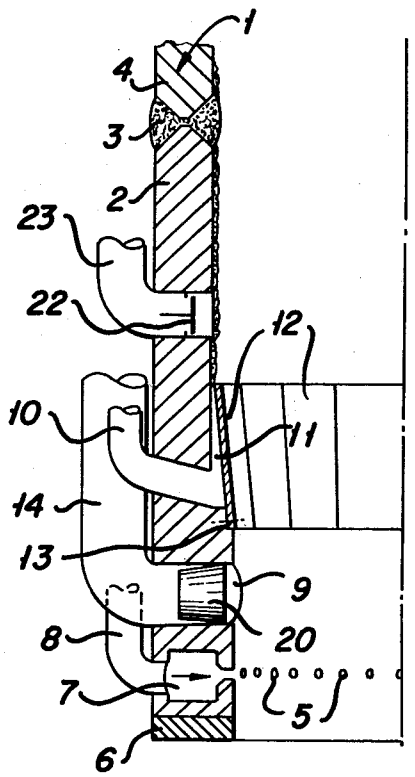
FIGS. 2 and 3 are corresponding partial longitudinal sections of two other embodiments of the lower portion of a hollow body according to the invention.

The spray nozzles 5 preferably lie about 2 cm above the lower edge of the hollow body 1, which in FIGS. 1 and 3 is formed by a wear resistent ring 6, adapted to take up the wear when the hollow body is being urged into the ground, so that this ring 6 has to be renewed regularly.

The spray nozzles 5, which are substantially directed to the center of the lower ring 2 of the hollow body 1 and which extend radially when the hollow body 1 is a tube with a circular section are connected to a circumferentially extending chamber 7, which is formed in the lower ring 2 and which communicates with a high-pressure line 8, which can be connected to a high-pressure pump for supplying fluid, for example bentonite, under high pressure.

Lines 8, 10 and 14 are not shown in proportion in the drawings, but rather are shown larger for illustrative purposes. The lines are preferably 20 to 25 mm. in diameter and occupy about one percent of the cross-sectional area of the hollow body 1. The lines are also disposed adjacent to the wall of the hollow body so that they do not disturb the driving thereof.

Of course, it is also possible to provide for this supply a number of high-pressure lines 8 uniformly spaced about the circumference of the hollow body 1 so as to prevent the occurrence of excentric forces.

The spray nozzles 5 serve for spraying the fluid under high pressure into the lower ring 2 and for cutting the ground in the lower ring 2 at the level of the spray nozzles 5.

Although it is possible to push the ground core in the hollow body 1 upwardly by means of this fluid under high pressure and thereby completely remove the ground out of the hollow body 1, in the embodiments shown in the drawings by way of example at least one but generally a number of inlet openings 9 are formed in the lower ring 2 at a higher level than the spray nozzles 5, which inlet openings 9 are spaced about the circumference of the lower ring 2 and open into the lower ring 2, while each inlet opening 9 has a greater passage than that of the spray nozzles 5.

The inlet openings 9 are connected to a line 10 or to a number of lines 10 uniformly spaced about the circumference, which line(s) 10 communicate with a pump of great output.

The use of these inlet openings 9 of great passage enables the ground core to be removed very quickly from the hollow body 1.

The vertical distance between the spray nozzles 5 and the inlet openings 9 can advantageously amount 2–4 cm.

At a higher level in the lower ring 2 a circumferentially extending channel 11 is formed by a number of transversely joining elastic elements 12, which are mounted on an annular thickening 13 of the lower ring 2, so that the inner diameter of the ring is smaller at the lower portion of the elastic elements 12 than at the upper end wherein the thickness amounts to 3–5 mm, the elastic elements 12 extending upwardly and outwardly from this thickening 13 and resting in the rest position with their upper edge against the inner wall of the lower ring 2.

One line 14 or a number of lines 14 spaced uniformly about the circumference of the hollow body 1 open(s) into the circumferentially extending channel 11, which line(s) 14 is (are) connected to a pump for the supply of a pressurized lubricant, such as bentonite.

It is an object of the lubricant to lubricate the inner wall of the hollow body 1 when this hollow body 1 is being urged into the ground, wherein the elastic elements 12 effectuate a uniform distribution of the lubricating fluid over the inner side of the hollow body 1.

The thickness of the lubricant coating has to be as low as possible in order to prevent, during the upward displacement of the ground core in the hollow body 1 by means of the pressurized fluid, this pressurized fluid from displacing the lubricant and thereby evading upwardly around the ground core in the hollow body 1.

The elastic elements 12 are slightly inclined upwardly and outwardly with respect to the center line of the hollow body 1 and after the hollow body 1 is eventually filled with concrete for forming a foundation element or the like in the ground, the elastic elements 12 allow this concrete to stream out of the hollow body 1 without any trouble and furthermore prevent that this concrete could penetrate into the circumferentially extending channel 11.

Figure 2:
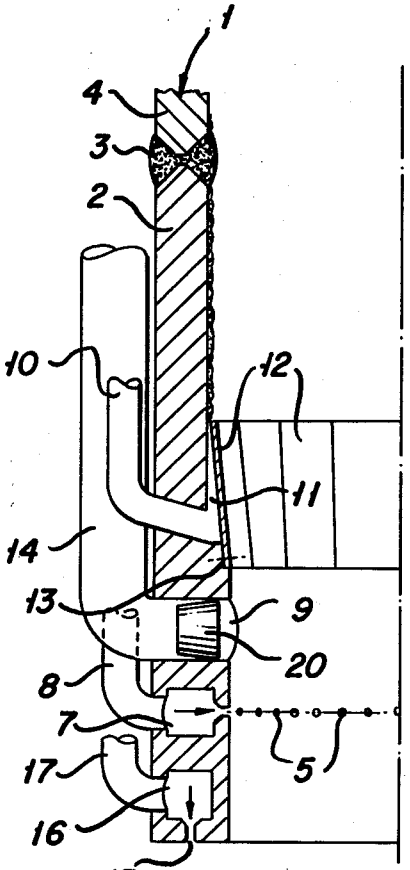

In the embodiment of the hollow body 1 according to FIG. 2 a number of throttle openings 15 are formed in the lower ring 2, which throttle openings 15 are spaced about the circumference of the lower ring 2 and the directed downwardy, whilst they open at the lower edge of the lower ring 2. These throttle openings 15 are connected to a lower circumferentially extending chamber 16 in the lower ring 2 communicating with a high-pressure line 17, which can be connected to a high-pressure pump for the supply of fluid under high pressure.

Of course, a number of high-pressure lines 17, which are uniformly spaced about the circumference of the hollow body 1 can again open into this lower circumferentially extending chamber 16, if desired.

The object of these downwardly directed throttle openings 15 is to spray fluid under high pressure into the underlying ground and thereby effectuate a fluidisation of this underlying ground, when the hollow body 1 is being urged and in particular is being vibrated into the ground so that the load required therefor is decreased considerably.

The method for forming a hole into the ground by means of the hollow body 1 according to FIG. 1 will hereafter be elucidated with reference to FIGS. 4–8.

At first, the hollow body 1 is urged into the ground down to the desired depth, which can be done by means of ramming, pushing or vibrating.

In the embodiment illustrated in FIGS. 4–8 by way of example, the lower portion of the hollow body 1 thereby penetrates into the supporting sand stratum 18. The stratums lying thereabove are indicated in the drawing by numeral 19.

When the hollow body 1 is being urged into the ground, a lubricant, such as bentonite, is supplied under pressure through the lines 14 into the circumferentially extending channel 11, whereafter under slight deformation of the elastic elements 12 this lubricant will leave in the upward direction at the upper side of this channel 11 thereby causing a lubrication of the inner wall of the hollow body 1.

The supply of the lubricant to the circumferentially extending channel 11 can be stopped when the hollow body 1 has reached the desired depth in the ground, but can also be continued during the further stages of the method, if desired.

Figure 4:
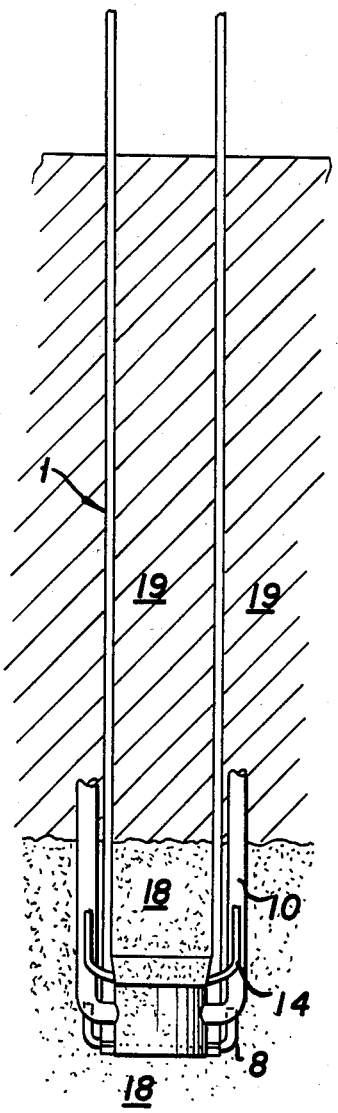
FIGS. 4–8 very schematically show different stages of the method according to the invention, wherein a hollow body according to FIG. 1 is used.

Hereupon, fluid, such as bentonite under high pressure is sprayed into the ground in the lower ring 2 through the supply lines 8 and via the circumferentially extending chamber 7 and the spray nozzles 5, causing the ground in this lower ring 2 to be cut at the height of these spray nozzles 5 (FIG. 4).

When pressurized fluid is supplied into the hollow body 1 through the spray nozzles 5 so as to cut the ground, it is preferred, if possible, to turn the hollow body 1 about its longitudinal axis through an arc, which is at least equal to the arc between adjacent spray nozzles 5.

Figure 5:
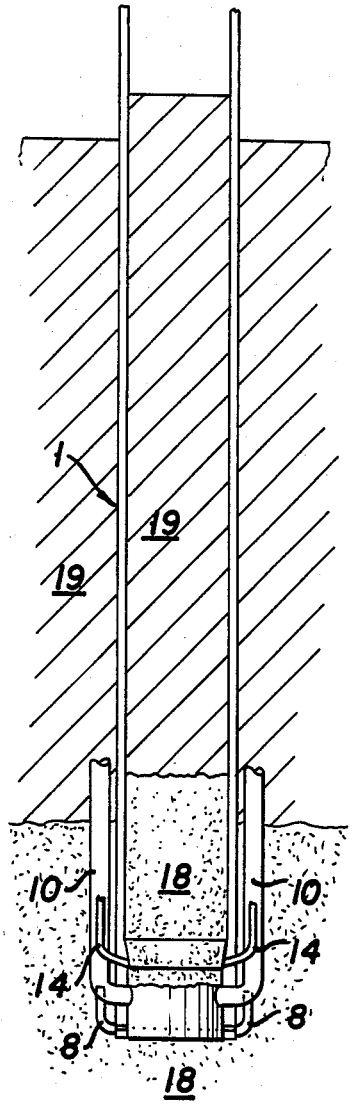
Figure 6:
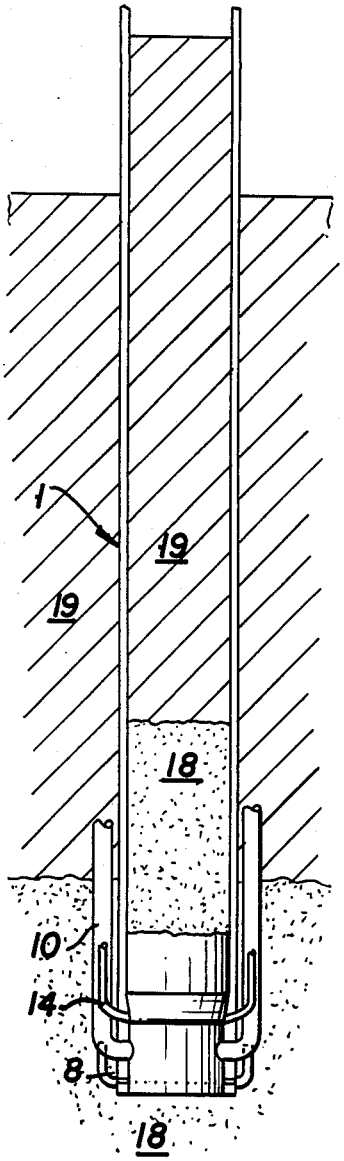

The fluid supply through the spray nozzles 5 is hereupon continued until the inlet opening(s) 9 lying above the spray nozzles 5 and having a greater passage than the passage of the spray nozzles 5 is (are) released (FIG. 5).

The inlet opening(s) 9 is (are) closed by a conical plug 20 when the hollow body 1 is being urged into the ground, and after this conical plug 20 is pushed away by the pressurized fluid, the inlet opening(s) 9 can be used for supplying the pressurized fluid, such as water, into the interior of the hollow body 1, whereby the upward displacement of the ground in the hollow body 1 is continued.

At this moment, the supply of pressurized fluid through the spray nozzles 5 can be interrupted; the pressure of this fluid will generally be higher than the pressure of the fluid, which is supplied through the inlet opening(s) 9.

However, the supply of pressurized fluid through the spray nozzles 5 can still be continued when the ground core in the hollow body 1 is being moved upwardly by means of the pressurized fluid, which is supplied through the inlet opening(s) 9, so as to enhance the upward pushing of the ground core column. Fluid is kept from flowing out of the lower end of the tubular hollow body by the ground below the fluid.

In order to prevent loose ground particles from falling down through the pressurized fluid, when the ground core column in the hollow body 1 is being displaced upwardly, so that the flat horizontal cut of the ground by means of the pressurized fluid supplied through the spray nozzles 5 would be eliminated, a coherent piston-like plug 21 is supplied or formed under the lower surface of the ground core column in the hollow body 1 (FIG. 7) after the ground core in the hollow body 1 is displaced upwardly by means of the pressurized fluid supplied through the inlet opening(s) 9 along such a distance that underneath the lower surface of the ground core column in the hollow body 1 sufficient space is released (FIG. 6), the plug 21 having a height of at least $\frac{1}{4}$ times the diameter and preferably at least $\frac{1}{2}$ times the diameter of the hollow body 1.

Generally, the piston-like plug 21 will be supplied or formed underneath the lower surface of the ground core in the hollow body 1, after the ground core in the hollow body 1 is displaced upwardly along a distance of at least half the diameter of the hollow body 1 and preferably along a distance of 50 cm–1 m.

This coherent piston-like plug 21 extends over the whole interior cross-section of the hollow body 1 and it prevents in the first place that loose ground core particles could still fall down when the ground column in the hollow body 1 is displaced upwardly.

Furthermore, this piston-like plug 21 forms an efficient lower partition of the annular space around the ground core in the hollow body, which is occupied by the lubricant, whereby it is prevented that pressurized fluid could escape upwardly through this annular space.

According to a preferred embodiment of the method swelling globules are temporarily added to the pressurized fluid, which is supplied through the inlet opening(s) 9 into the hollow body 1, the swelling globules having a specific weight which is higher than that of the pressurized fluid being used. This swelling globules swell after some time, for instance after 5 minutes and then rise, whilst they form a coherent piston-like plug 21 of foam underneath the lower surface of the ground core in the hollow body 1.

The supply of the pressurized fluid through the inlet opening(s) 9 in the hollow body 1 is interrupted after addition of the swelling globules until this swelling globules are swelled and have risen to the lower surface of the ground core in the hollow body 1. Hereupon, the supply of pressurized fluid is restarted and the upward pushing of the ground core in the hollow body 1 is continued (FIG. 8) until all the ground core is removed from this hollow body 1.

As an alternative for using swelling globules it is possible to temporarily add big foam pellets or plastics globules to the pressurized fluid which is supplied through the inlet opening(s) 9 in the hollow body 1, wherein the pellets or globules can just pass through the line(s) 11 with a clearance of a few mm and will form the coherent piston-like plug 21 underneath the lower surface of the ground core in the hollow body 1.

Furthermore, it is possible, as shown in FIG. 3, that at least one further line 23 provided with a non-return valve 22 is connected to the lower ring 2 at a higher level than the spray nozzles 5 and in FIG. 3 at a higher level than the elastic elements 12. Through these line(s) 23 foam material can be supplied into the hollow body 1, which forms the coherent piston-like plug 21 underneath the lower surface of the ground core in the hollow body 1.

Figure 7:
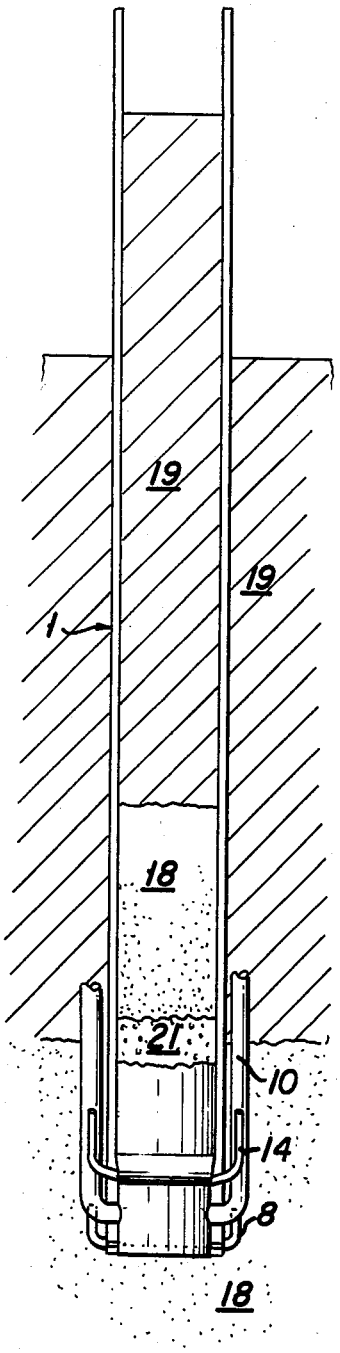
Figure 8:
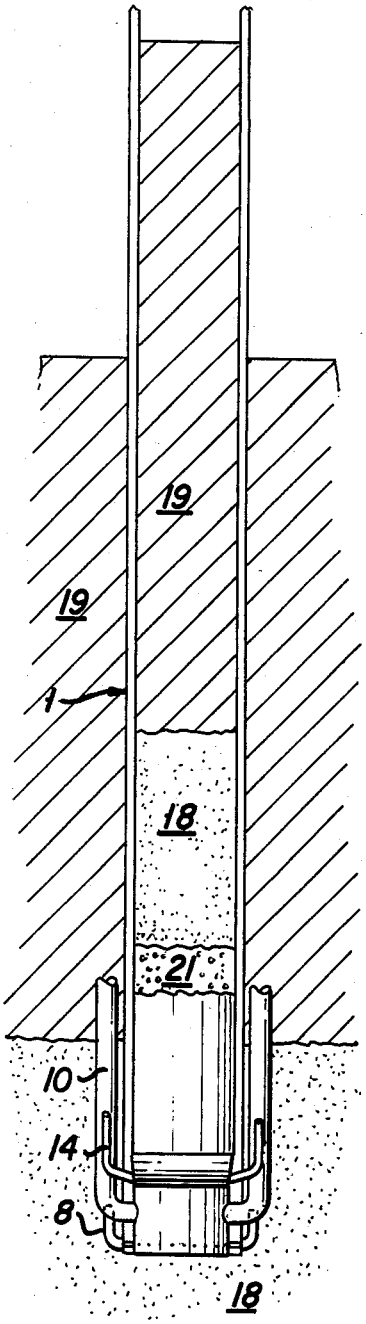
Figure 9:
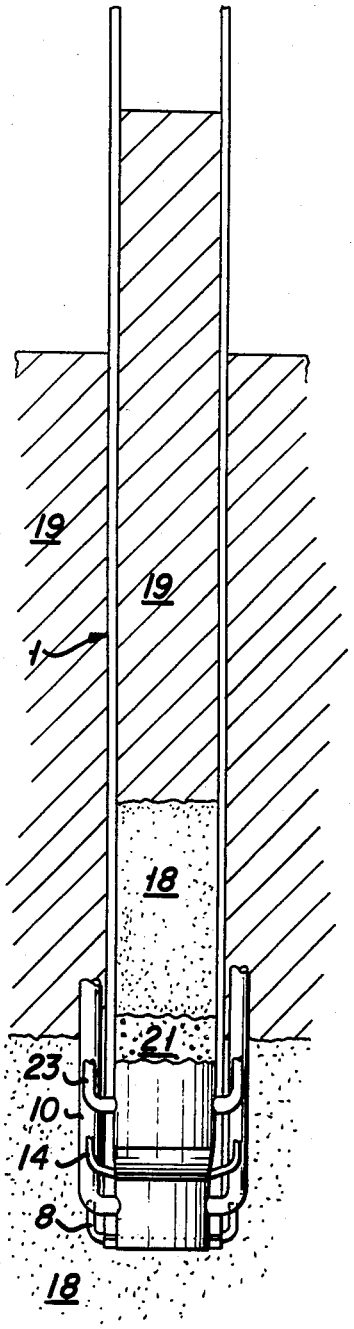
FIG. 9 shows a stage of the method according to the invention corresponding to FIG. 7 wherein, however, a hollow body according to FIG. 3 is used.

FIG. 9 illustrates the stage of the method described corresponding to FIG. 7, wherein, however, the hollow body of FIG. 3 is used. In FIG. 9 the just formed piston-like plug 21 consists of foam material supplied through the lines 23.

It is also possible to supply different components through a number of lines 23 into the hollow body 1, which components together form a foam, acting as a coherent plug 21 underneath the lower surface of the ground core in the hollow body 1.

Furthermore a bentonite-cement mixture can be supplied through one or more lines 23 into the hollow body 1, which mixture is activated with soluble glass or the like and formes the piston-like plug 21 underneath the lower surface of the ground core in the hollow body 1.

Although it is described hereinbefore that the upward displacement of the ground core column in the hollow body 1 together with the underlying piston-like plug 21 is effected by means of the pressurized fluid supplied through the line(s) 10, it is also possible to effect this only by means of the pressurized fluid supplied through the line(s) 8. However, in this latter case, the pace of work is substantially slower.

After the ground core column and the underlying piston-like plug 21 are completely pushed out of the hollow body 1, a reinforcement can be lowered into the hollow body 1, whereupon concrete can be poured into the hollow body 1. When the concrete is being supplied into the hollow body 1, the hollow body 1 is generally being lifted, so that the concrete completely fills out the hole in the ground.

The foundation element which is formed in this way, is completely flat at its lower side and extends truly horizontally.

The invention is not restricted to the embodiments shown in the drawings and described in the specification by way of example, which can be varied in different ways within the scope of the invention.

What is claimed is:

1. A hollow body having upper and lower sides, the hollow body being open at said lower and upper sides and being adapted for use in a method for forming a hole, such as a foundation element in the ground, said hollow body further comprising:

a plurality of circumferentially-spaced spray nozzles directed into said hollow body at a small distance above a lower edge of the lower side, the spray nozzles being substantially directed to a center point of the hollow body, the center lines of the spray nozzles lying in one transverse plane;

a first supply line connecting the spray nozzles to a pressurized fluid supply;

at least one inlet opening which has a greater cross-sectional area than that of the spray nozzles which opens into the hollow body above the spray nozzles; and a second supply line adapted to connect the inlet opening to a supply of pressurized fluid.

2. A hollow body as claimed in claim 1, wherein the spray nozzles lie about 2 cm above the lower edge of the lower side.

3. A hollow body as claimed in claim 1, wherein the spray nozzles communicate with a circumferentially extending chamber in the hollow body, which is connected to the first supply line.

4. A hollow body as claimed in claim 1, wherein a circumferentially extending channel is formed in the hollow body by transversely joining elastic elements at a level higher than the spray nozzles, the elastic elements being mounted on an annular thickening of the wall of the hollow body and extending upwardly and outwardly from a lowermost point of a thickening and resting in the rest position with their edge against the inner wall of the hollow body, wherein at least one line opens into the circumferentially extending channel and is adapted to be connected to a supply of a pressurized lubricant.

5. A hollow body as claimed in claim 1, wherein the vertical distance between the spray nozzles and the inlet opening(s) amounts to 2–4 cm.

6. A hollow body as claimed in claim 1, wherein at least one further line which opens into the hollow body is connected to a supply for a material for forming a piston like plug.

7. A hollow body as claimed in claim 1, wherein the hollow body comprises a wear resistant ring at its lower side.

8. A hollow body as claimed in claim 1, wherein the hollow body comprises a lower ring, in which the spray nozzles, the inlet opening(s) and the circumferentially extending channel are formed.

9. A hollow body as claimed in claim 8, wherein a number of throttle openings are formed in the lower ring, which throttle openings are spaced about the circumference of the lower ring and are directed downwardly, the throttle openings open at the lower edge of the lower ring adapted to be connected to a supply of pressurized fluid through at least one line.

10. A hollow body as claimed in claim 9, wherein a lower circumferentially extending chamber is formed in the lower ring, which lower circumferentially extending chamber is connected to the respective line(s) and communicates with the throttle openings.

11. A method for forming a hole in the ground by using a hollow body with a lower and an upper side, said hollow body being open at said lower and upper sides, the method including the sequential steps of:

urging the hollow body to vertically displace it into the ground;

stopping the vertical displacement of the hollow body when it has been brought to a desired depth in the ground;

spraying pressurized fluid into the hollow body at a small distance above the edge of the lower side of the hollow body from a plurality of circumferentially spaced spray nozzles, which open into the hollow body and lie at the same height as the spray nozzles, whereby the sprayed pressurized fluid effects a transverse cutting of the ground in the hollow body at the height of the spray nozzles, wherein the sprayed pressurized fluid displaces the overhead ground core upwardly along some distance in the hollow body until at least one inlet opening having a greater cross-sectional area than that of the spray nozzles is released by the ground core;

supplying a pressurized fluid through the at least one inlet opening into the hollow body, which fluid continues until the upward displacement of the ground core in the hollow body, to remove the ground core from the hollow body.

12. A method as claimed in claim 11, wherein the pressure of the fluid which is supplied through the spray nozzles is higher than the pressure of the fluid which is supplied through the inlet opening(s).

13. A method as claimed in claim 11, wherein during supply of the pressurized fluid through the spray nozzles into the hollow body, this hollow body is turned through an are which is at least equal to the arc between adjacent spray nozzles.

14. A method as claimed in claim 11, wherein when the hollow body is being urged into the ground, pressurized fluid is sprayed downwardly out of throttle openings which open into the edge of the lower side of the hollow body and which are spaced about the circumference thereof.

15. A method as claimed in claim 11, wherein the inlet opening(s) is (are) closed with a plug, when the hollow body is being urged into the ground.

16. A method as claimed in claim 11, wherein a lubricating fluid is sprayed into the hollow body through the spray nozzles when the hollow body is being urged into the ground.

17. A method as claimed in claim 11, wherein at least when the hollow body is being urged into the ground, the inner wall of said hollow body is lubricated with a lubricant, which is supplied under pressure in an upward direction along the inner wall of the hollow body near the lower side thereof but at a higher level than the spray nozzles.

18. A method as claimed in claim 17 wherein the lubricating fluid is bentonite.

19. A method as claimed in claim 11 further comprising the step of injecting a sealing means underneath the lower surface of the ground core to form a piston-like plug having a height of at least ¼ the diameter of the hollow body and extending over the entire interior cross section of the hollow body.

20. A method as claimed in claim 19, wherein the piston-like plug is supplied after the ground core has been displaced upwardly along 50 cm–1 m.

21. A method as claimed in claim 19, wherein the sealing means comprises swelling globules added to the pressurized fluid, which is supplied through the inlet opening(s) into the hollow body, the swelling globules rising upwardly after they have been swelled and forming the piston-like plug underneath the lower surface of the ground core.

22. A method as claimed in claim 21, wherein after the addition of the swelling globules the supply of the pressurized fluid through the inlet opening(s) in the hollow body is interrupted until the swelling golubles have been swelled and have risen to the lower surface of the ground core in the hollow body.

23. A method as claimed in claim 19, wherein foam pellets are temporarily added to the pressurized fluid which is supplied through the inlet opening(s) in the hollow body, the foam pellets forming the piston-like plug underneath the lower surface of the ground core in the hollow body.

24. A method as claimed in claim 19, wherein plastics globules are temporarily added to the pressurized fluid which is supplied through the inlet opening(s) in the hollow body, the plastics globules forming the piston-like plug underneath the lower surface of the ground core in the hollow body.

25. A method as claimed in claim 19, wherein foam material is supplied into the hollow body through a line, which opens into the hollow body at a higher level than the spray nozzles, the foam material forming the piston-like plug underneath the lower surface of the ground core in the hollow body.

26. A method as claimed in claim 19, wherein different components which together form a foam are supplied into the hollow body through a number of lines, which open into the hollow body at a higher level than the spray nozzles, the foam acting as the piston-like plug underneath the lower surface of the ground core in the hollow body.

27. A method as claimed in claim 19, wherein a bentonite cement mixture is supplied into the hollow body through a line which opens into the hollow body at a higher level than the spray nozzles, the bentonite cement mixture being activated with soluble glass and forming the piston-like plug underneath the lower surface of the ground core in the hollow body.

* * * * *